US008833613B2

(12) United States Patent
Rigolio

(10) Patent No.: US 8,833,613 B2
(45) Date of Patent: Sep. 16, 2014

(54) CONTAINER FOR CYLINDER

(75) Inventor: Riccardo Rigolio, Olgiate Olona (IT)

(73) Assignee: Rigo S.R.L., Olgiate Olona (VA) (IT)

( * ) Notice: Subject to any disclaimer, the term of this patent is extended or adjusted under 35 U.S.C. 154(b) by 73 days.

(21) Appl. No.: 13/511,242

(22) PCT Filed: Nov. 23, 2010

(86) PCT No.: PCT/EP2010/067997

§ 371 (c)(1),
(2), (4) Date: May 22, 2012

(87) PCT Pub. No.: WO2011/064195

PCT Pub. Date: Jun. 3, 2011

(65) Prior Publication Data

US 2012/0234869 A1 Sep. 20, 2012

(30) Foreign Application Priority Data

Nov. 25, 2009 (IT) ..... MI2009A2068

(51) Int. Cl.

| | |
|---|---|
| ***G01F 11/00*** | (2006.01) |
| ***B65D 83/38*** | (2006.01) |
| ***B65D 21/08*** | (2006.01) |
| ***B65D 83/20*** | (2006.01) |
| *B05B 9/08* | (2006.01) |

(52) U.S. Cl.

CPC ..... *B65D 83/202* (2013.01); *B65D 83/384* (2013.01); *B65D 21/086* (2013.01); *B05B 9/0805* (2013.01)

USPC ..... 222/325; 222/153.11; 222/162; 222/190; 222/402.1

(58) Field of Classification Search

USPC ..... 222/325, 190, 162, 153.01, 153.11, 222/402.1

See application file for complete search history.

(56) References Cited

U.S. PATENT DOCUMENTS

| | | | | |
|---|---|---|---|---|
| 5,765,708 | A | 6/1998 | Fragos | |
| 6,367,663 | B1 * | 4/2002 | Condon et al. | 222/190 |
| 6,484,897 | B1 | 11/2002 | Crawley | |
| 6,588,627 | B2 * | 7/2003 | Petterson et al. | 222/1 |
| 7,641,079 | B2 * | 1/2010 | Lott et al. | 222/402.13 |
| 2004/0129730 | A1 * | 7/2004 | Parsons | 222/153.11 |

FOREIGN PATENT DOCUMENTS

| | | |
|---|---|---|
| DE | 1801838 | 6/1970 |
| GB | 2152468 | 8/1985 |
| NL | 8501587 | 1/1987 |

* cited by examiner

*Primary Examiner* — Frederick C Nicolas
(74) *Attorney, Agent, or Firm* — Jacobson Holman, PLLC.

(57) ABSTRACT

A cylindrical container for preferably foam compound cylinder is described, including a base portion separately couplable with a head portion, the head portion including an attachment flange adapted to accommodate a valved head of the cylinder and couplable with an attachment flange of an application device of the substance contained in the cylinder, and attachment part engageable with a thread of the base portion.

8 Claims, 12 Drawing Sheets

CONTAINER FOR CYLINDER

This is a national stage of PCT/EP10/067,997 filed Nov. 23, 2010 and published in English, which claims the priority of Italian number MI2009A 002068 filed Nov. 25, 2009, hereby incorporated by reference.

FIELD OF THE INVENTION

The present invention relates to a container for cylinder with attachment for application means, for example an application gun.

DESCRIPTION OF THE RELATED ART

The use of guns is known for the application of foamy substances in the construction field and for the do-it-yourself.

The foamy substances are useful for example for installing and thermally insulating sashes of doors, windows and rolling-shutter boxes; insulating thermohydraulic and conditioning systems; sealing and filling holes, cracks and cavities in roofs and walls, gluing cover panels.

The foaming substance, e.g. polyurethane, is contained in compressed form in cylinders with opening/closure valves.

Said guns include a flanged attachment for the cylinders adapted to allow the valve to be opened and therefore the foaming substance to be inlet for the application thereof which will expand when it comes in contact with the external environment.

The operation of attaching the cylinder to the gun is a critical step as it is required to open the valve only once the attachment has been made thus limiting to the utmost the leakage of foaming substance.

Normally the head of the cylinder, about the valve, is equipped with a ring with external thread couplable with the internal thread of the attachment of the gun. The rotation of the cylinder with respect to the gun determines both the attachment and the progressive opening of the valve.

Disadvantageously, there is often foam leakage because the rotation of the cylinder is progressive and therefore the valve starts opening before there is sealing between the gun and cylinder.

Consequently the operator is always forced to work with a dirty attachment which over time always makes the replacement of the cylinder increasingly difficult thus accelerating the wear of the gun. Furthermore the leakage of foamy material (often polyurethane) is certainly not an environmentally friendly event.

DE-1801838-A1 describes a container composed of two parts for accommodating a cylinder.

SUMMARY OF THE INVENTION

It is the object of the present invention to make a container for cylinders preferably containing foamy material associable with means of application such as guns, capable of eliminating the leakage of material, which is safe, fast and versatile to use.

In accordance with the invention, such an object is achieved with a cylindrical container for preferably foam compound cylinder comprising a base portion separately couplable with a head portion, and coupling means engageable with a thread of the base portion, characterized in that the coupling means comprise at least an arm with teeth adapted to engage with a screw-female type attachment to a thread obtained on the external surface of the base portion adapted to be inserted in the head portion.

These and other features of the present invention will become increasingly apparent from the following detailed description of one of its exemplary non-limiting practical embodiments disclosed in the accompanying drawings, in which:

Figure 1:
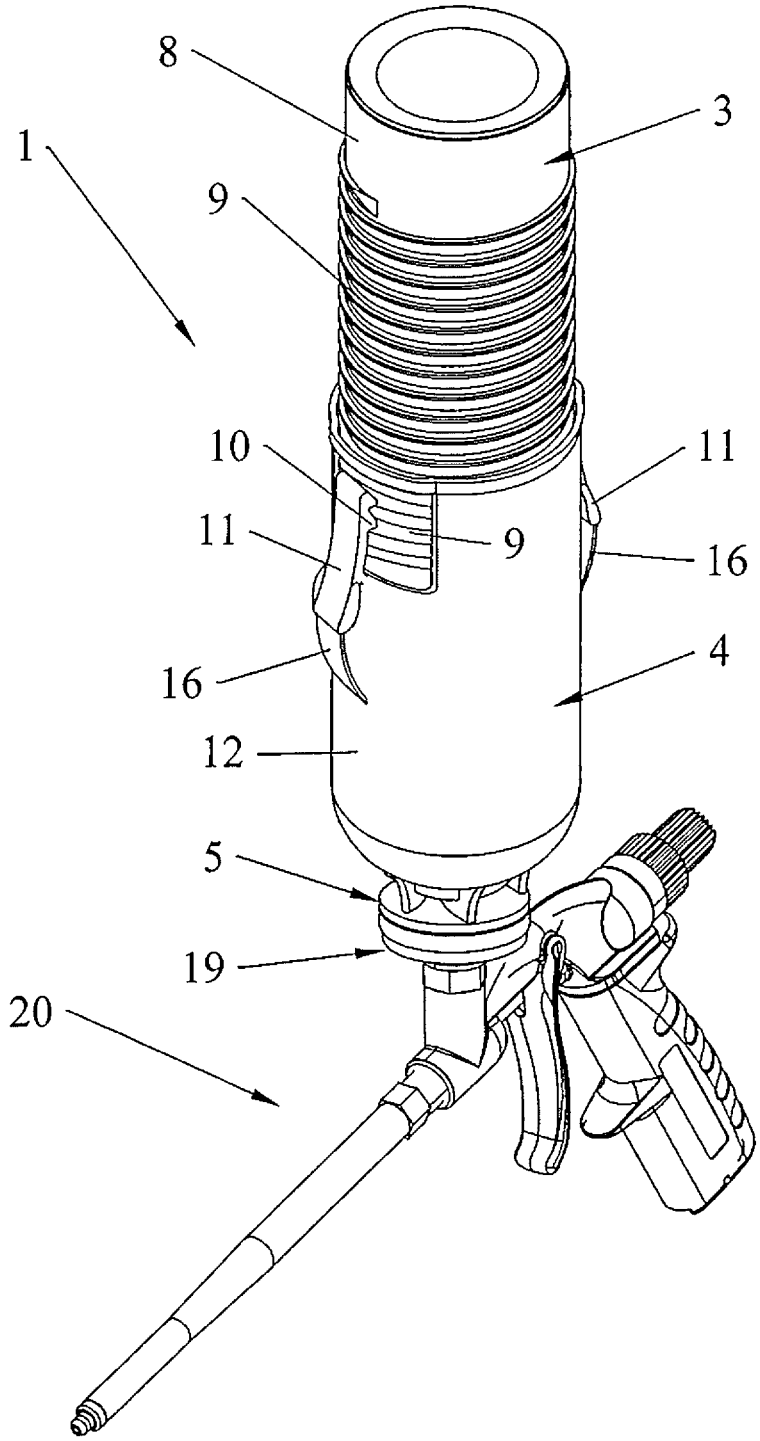
FIG. 1 shows a perspective view of a container coupled with a gun.
Figure 2:
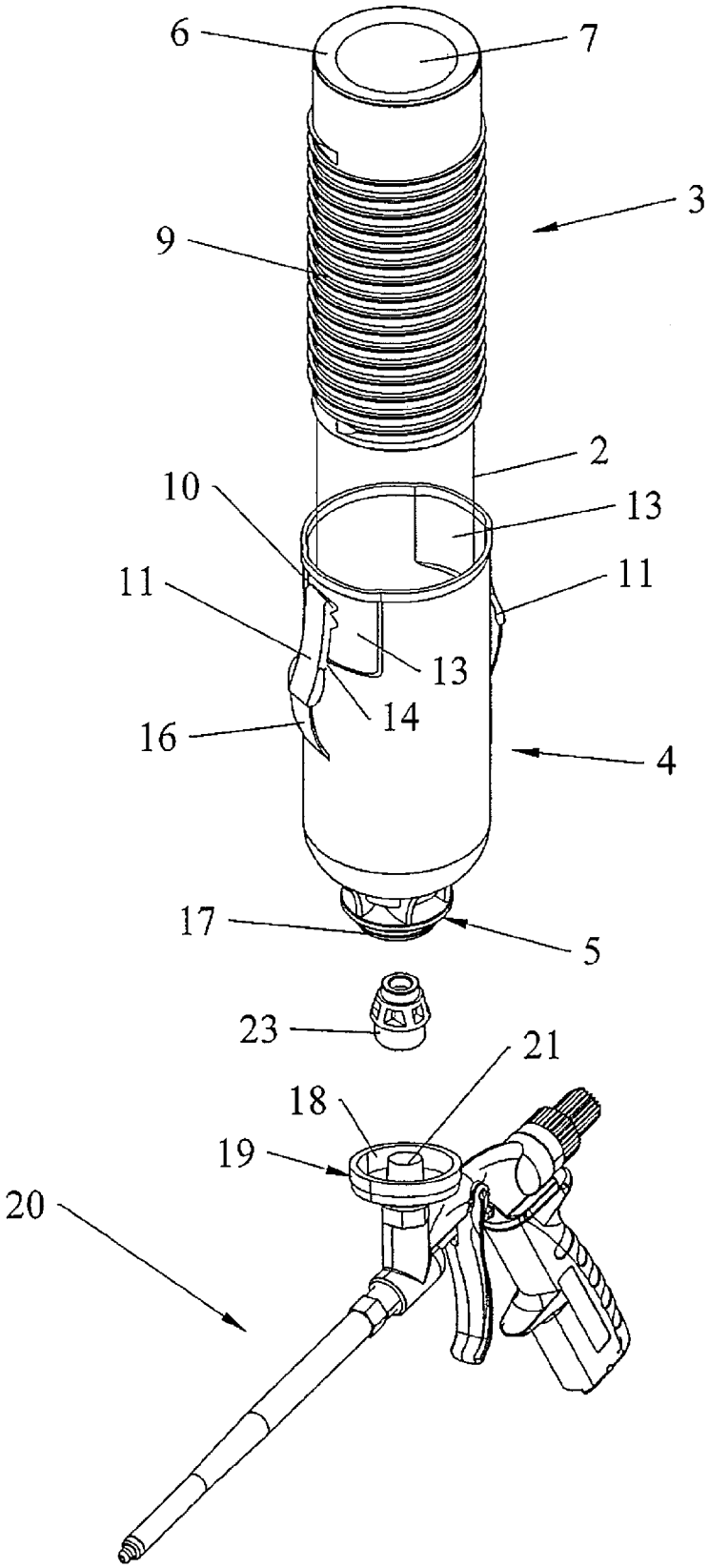
FIG. 2 shows a perspective view of the container uncoupled from the gun.

A hollow transparent cylindrical container 1 made with plastic material, preferably polypropylene 1, for cylinder 2 containing compressed polyurethane foam consists of a portion of hollow cylindrical base 3 couplable with a portion of hollow cylindrical head 4 having an attachment flange 5.

DETAILED DESCRIPTION OF THE INVENTION

The base 3 has a closed bottom 6 with external cavity 7 and an external surface 8 with external thread 9 adapted to engage with teeth 10 of a pair of arms 11 associated with the external surface 12 of the head 4.

The base 3 is sized so as to be inserted inside the head 4 which includes a pair of windows 13 through which the contact occurs between the teeth 10 and the thread 9.

The arms 11 are integral with the external surface 12 of the head 4 by means of two horizontal connecting strips 14 which permit a minimum rotation useful for nearing or separating the teeth of the thread 9. The end 15 of the arms 11 opposite to the teeth 10 is connected to the external surface 8 of the head 4 by means of a slightly elastic curved profile 16 useful for ease of movement of the teeth 10.

The arms 11 are not symmetric with respect to the axis of the cylindrical container 1 to allow the teeth 10 to be coupled with the thread 9 at vertically various heights, thus taking on the right rotation pitch. The windows 13 also have various sizes to adapt to the various lengths of the two arms 11. Essentially the teeth 10 are a threaded portion adapted to engage with the thread 9.

The attachment flange 5 of the head 4 includes an external thread 17 adapted to couple with an internal thread 18 of an attachment flange 19 integral with a gun 20 for applying the foaming substance.

An entry hole 21 for the foaming substance is provided at said attachment flange 19 to be coupled and adapted to open the valve 22 of the head 50 of the cylinder 2.

The figures also show an adaptor 23 useful for using different non-standard cylinders with container 1 and gun 20 with standard attachments 5, 19.

Figure 3:
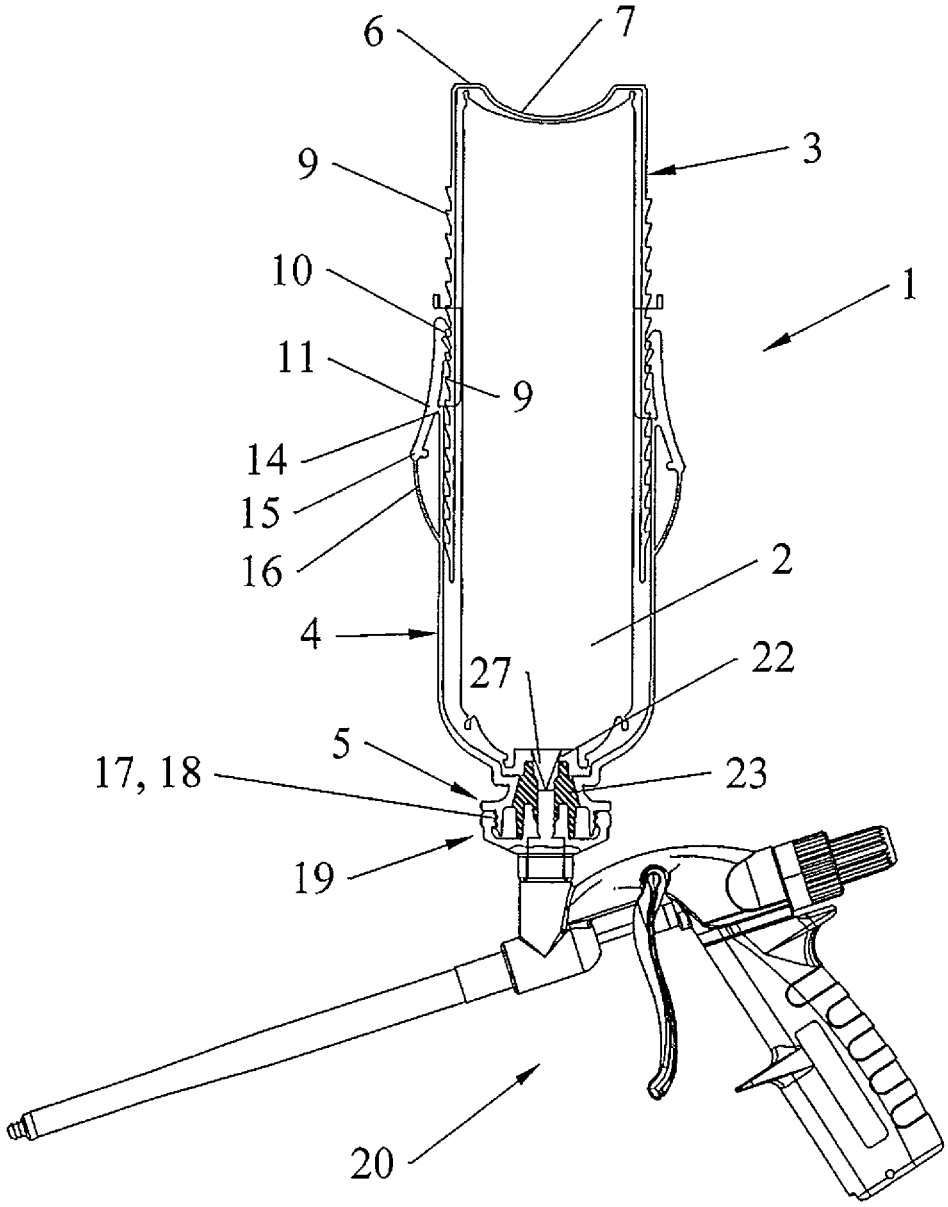
FIG. 3 shows a partially cross-sectioned front view of the container coupled with the gun.
Figure 4:
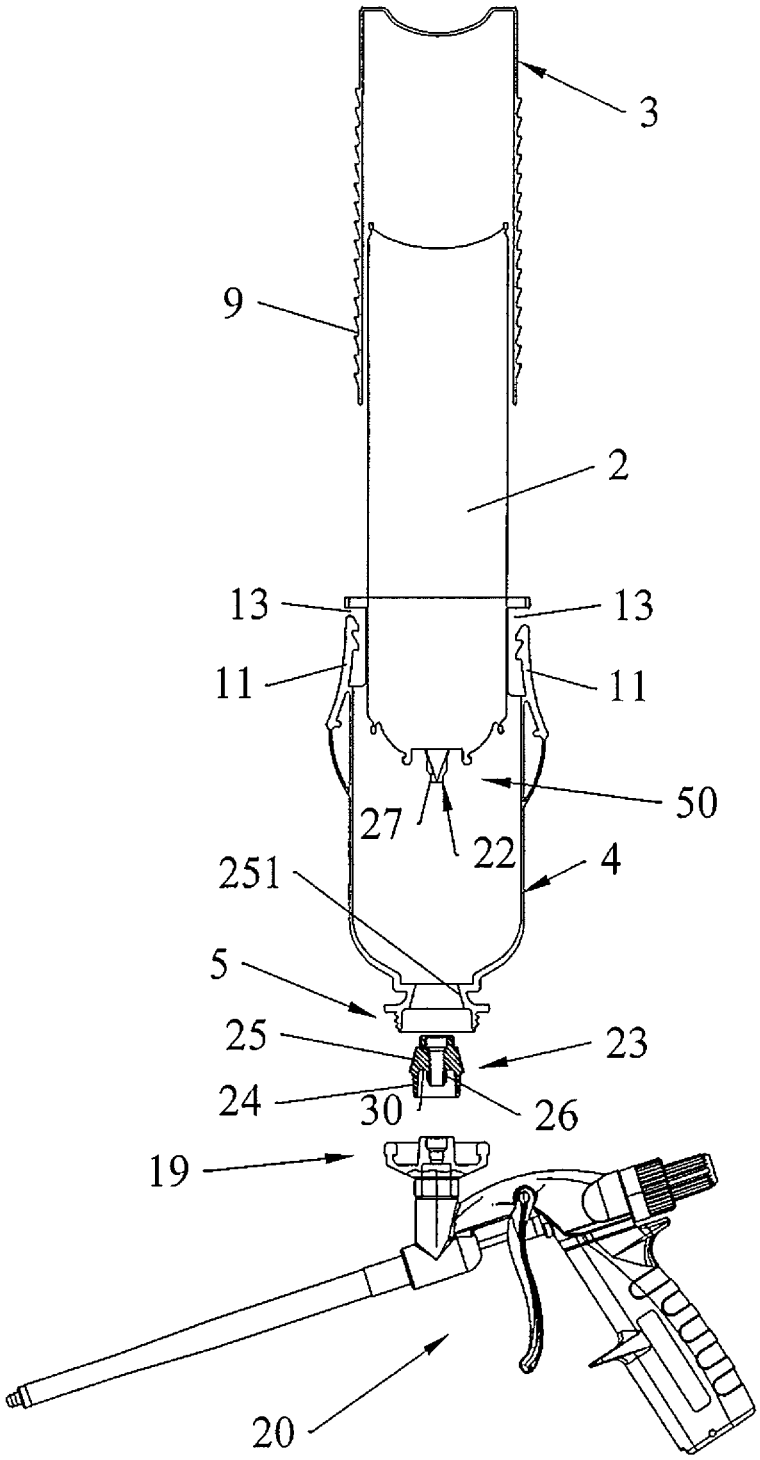
FIG. 4 shows a partially cross-sectioned front view of the container uncoupled from the gun.

The adaptor 23 consists of a cylindrical portion 24 (FIGS. 3-4) which engages the gun 20 and a truncated-conical portion 25 which couples with a flare 251 of the flange 5 of the container 1. A passing hole 26 is provided inside which couples on one hand with the hole 21 of the attachment flange 19 of the gun, and on the other with a pin 27 of the valve 22 of the cylinder 2. Furthermore the adaptor 23 has an internal ring-shaped rib 30 adapted to interact with the head edge of the hole 21 of the flange 19. The size of said rib 30 is very small and therefore not seen in the drawings even though it is explicitly indicated in FIG. 4.

The assembly of the above-described components occurs in the following way.

The cylinder 2 is inserted in the head 4 which is forced closed downward from the base 3 until the head 50 with the valve 22 of the cylinder 2 is brought in contact with the flange 5 of the head 4 of the container 1. During this step the external thread 9 translates axially on the shaped teeth 10 to allow the sliding only in the direction of closure unless there is pressure on the arms 11 by the operator.

The container 1 is then connected to the gun 20 by coupling said threads 17 and 18 of the two attachment flanges 5 and 19. If the valve 22 of the cylinder 2 does not adapt to the flange 19 of the gun 20, the use of an adaptor 23 is provided.

The cylinder 2 is still closed but hermetically separated from the external environment.

The screw-female coupling between the base 3 and the teeth 10 is designed to allow an axial advancement of 2-3 mm (average opening travel of the valves of the cylinders on the market); thereby a rotation of the base 3 between 60° and 120° is sufficient to completely and quickly open the valve 22. One single twisting movement is sufficient to the operator to cause said rotation. Consequently the leakage of foam in the attachment zone is limited if not absent and nevertheless does not invade the external environment as in any case it remains inside the container 1.

Advantageously the rib 30 permits to localize any deformations of the adaptor 23 due to the pressure of the head edge of the hole 21 on the adaptor 23. Otherwise there could be an outwards leakage of foam, albeit slight, due to the failed sealing of the flange 19 of the gun 20.

The container 1 according to the invention involves an economic saving, is lightweight, safe, universal and flexible; it is reusable, simple and practical to use; maintenance is almost non-existent; it solves the problem of cleaning the adaptor; it is transparent and therefore it is easy to notice leaked foam.

Moreover it is safe for the operator as if the gun falls there will not be foam leakage due to the detachment of said ring from the cylinder or perforating of the cylinder itself.

Figure 5:
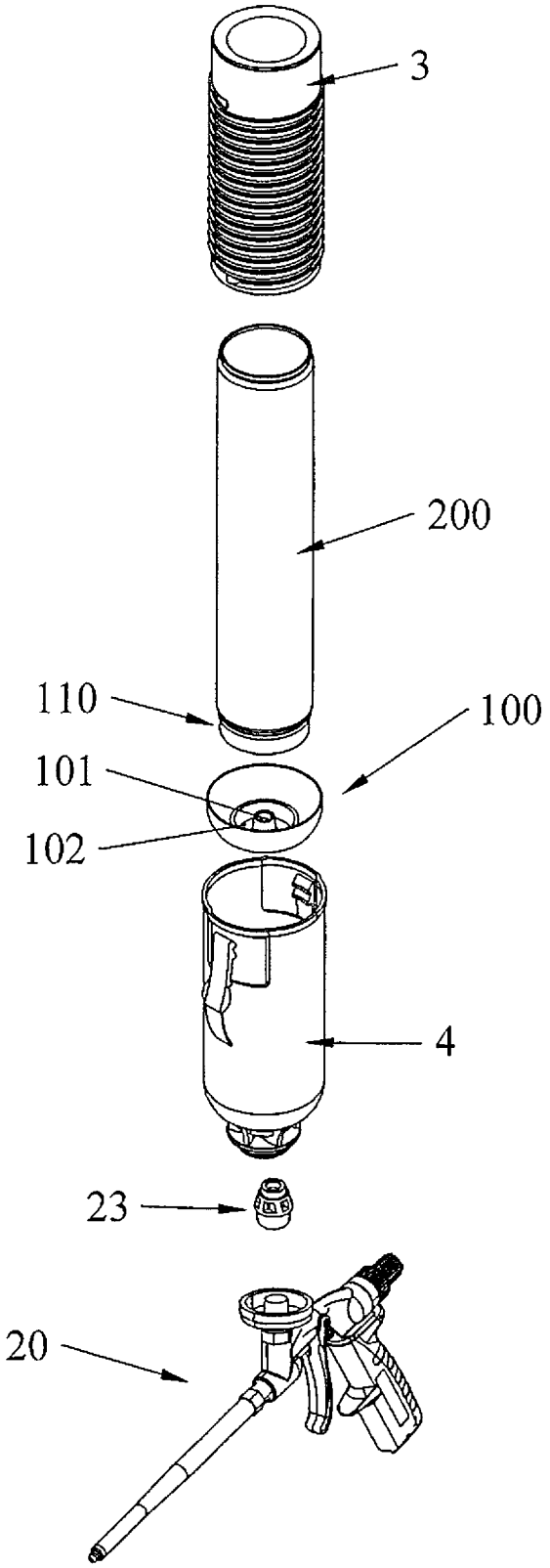
FIG. 5 shows a similar view to the one in FIG. 2 with the addition of an internal adaptor.
Figure 6:
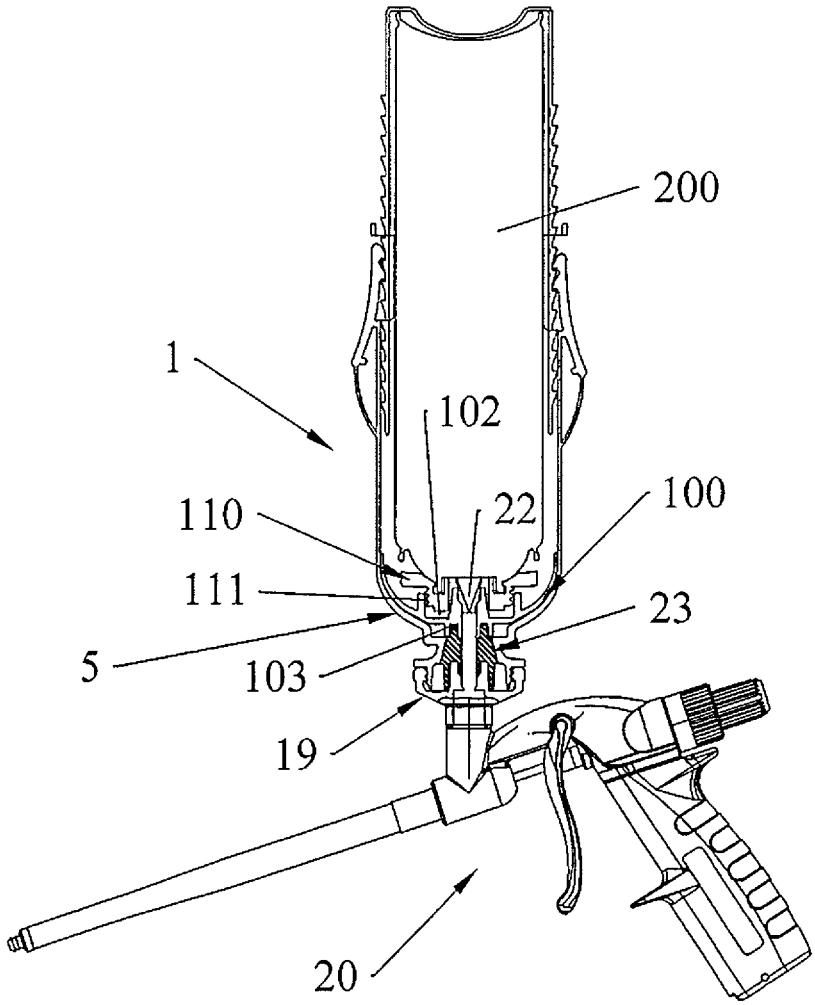
FIG. 6 shows a similar view to the one in FIG. 3 with the addition of the internal adaptor.
Figure 7:
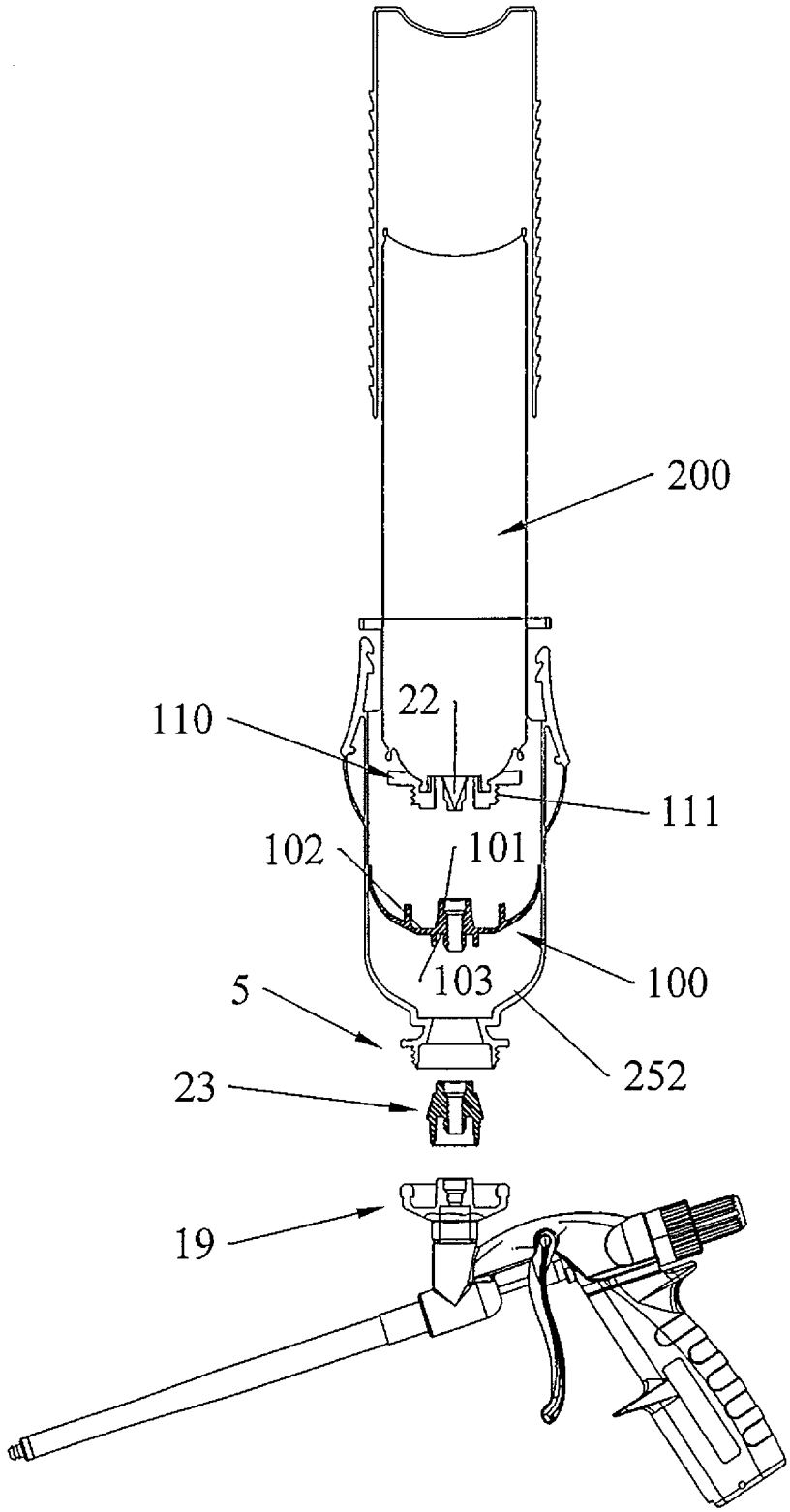
FIG. 7 shows a similar view to the one in FIG. 4 with the addition of the internal adaptor.
Figure 8:
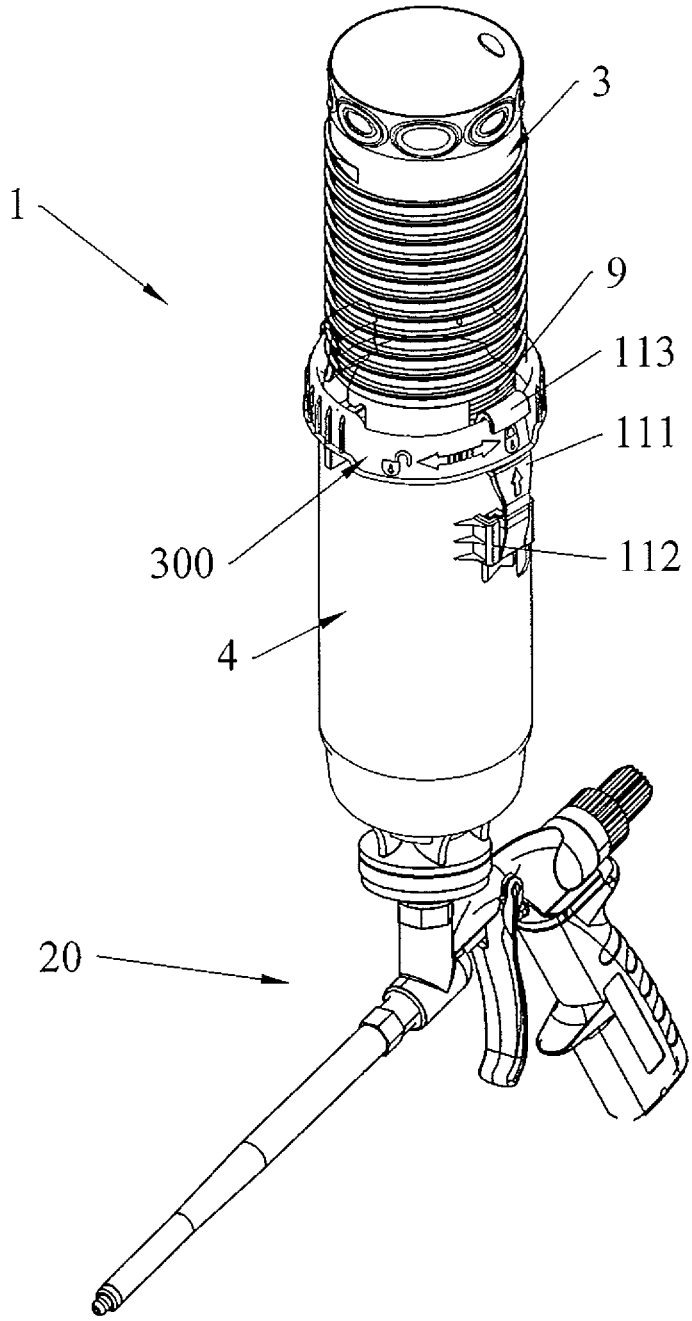
FIG. 8 shows a perspective view of the container with safety clamp in sealing position.
Figure 9:
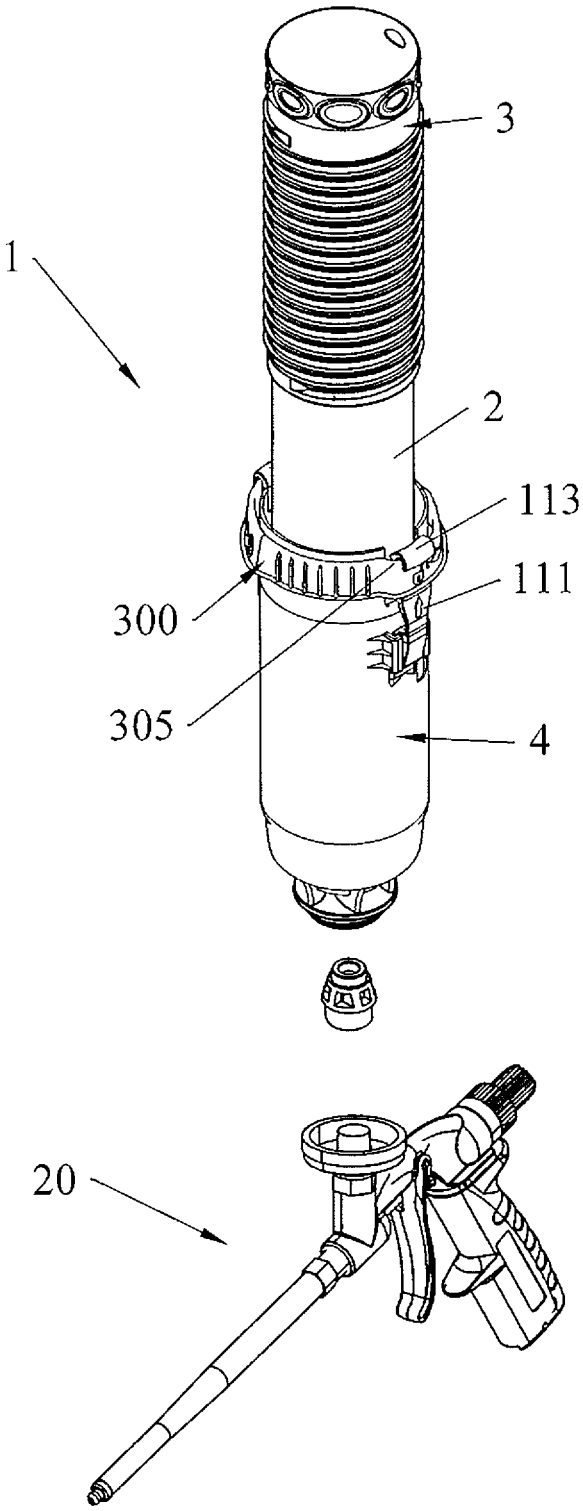
FIG. 9 shows a perspective view of the container with safety clamp in release position.
Figure 10:
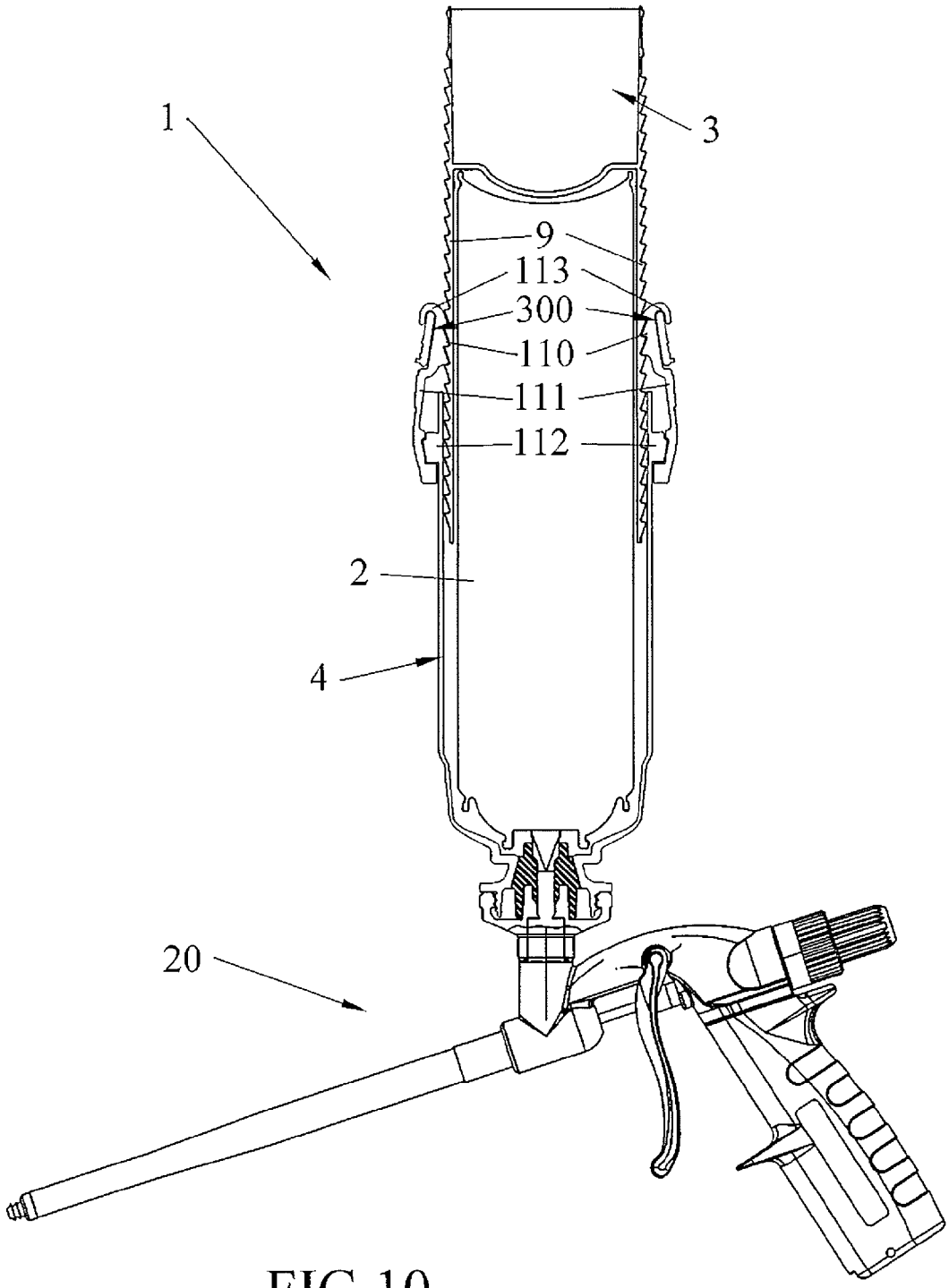
FIG. 10 shows a partially cross-sectioned front view of the container with safety clamp in sealing position.
Figure 11:
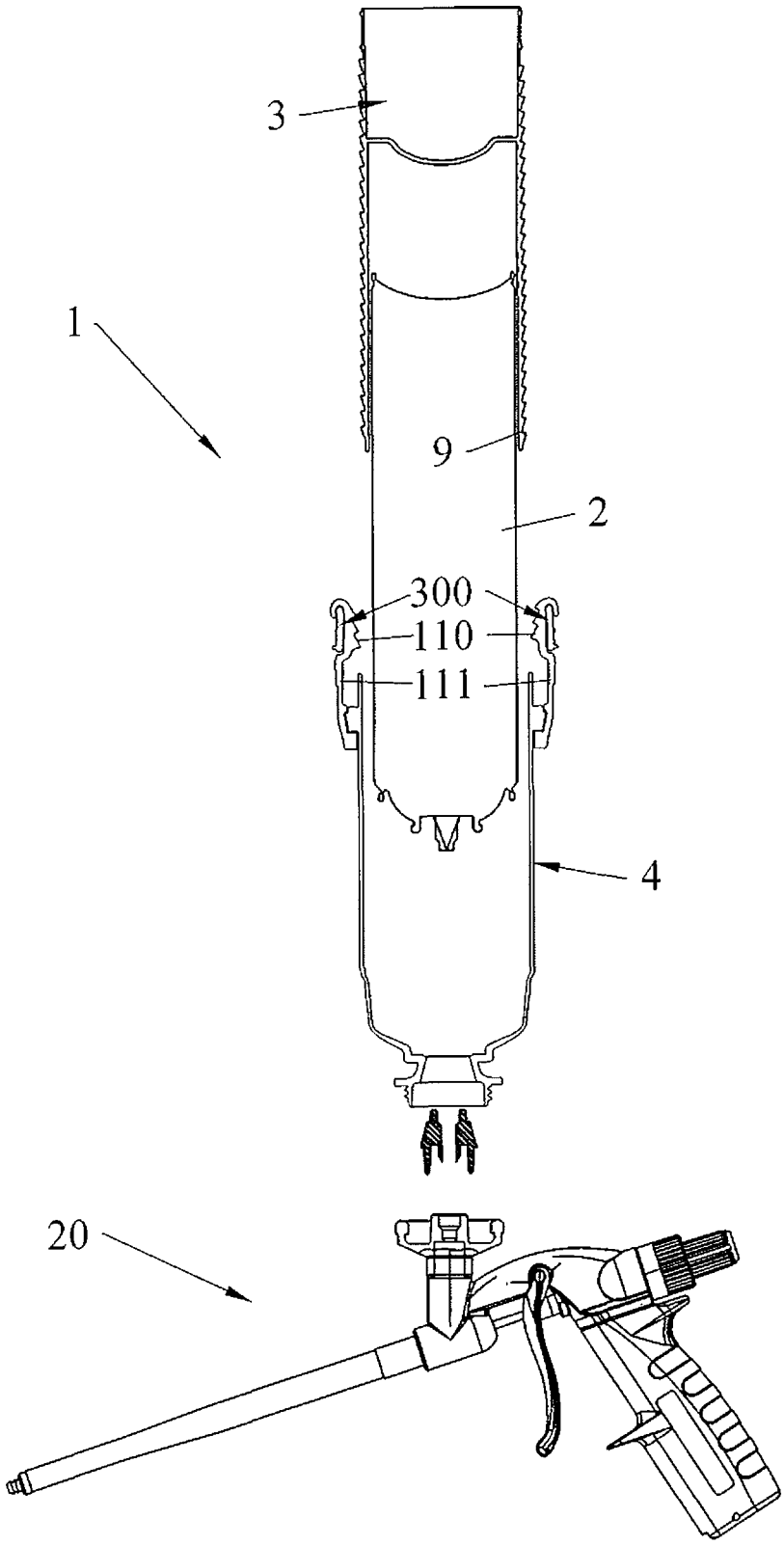
FIG. 11 shows a partially cross-sectioned front view of the container with safety clamp in release position.
Figure 12:
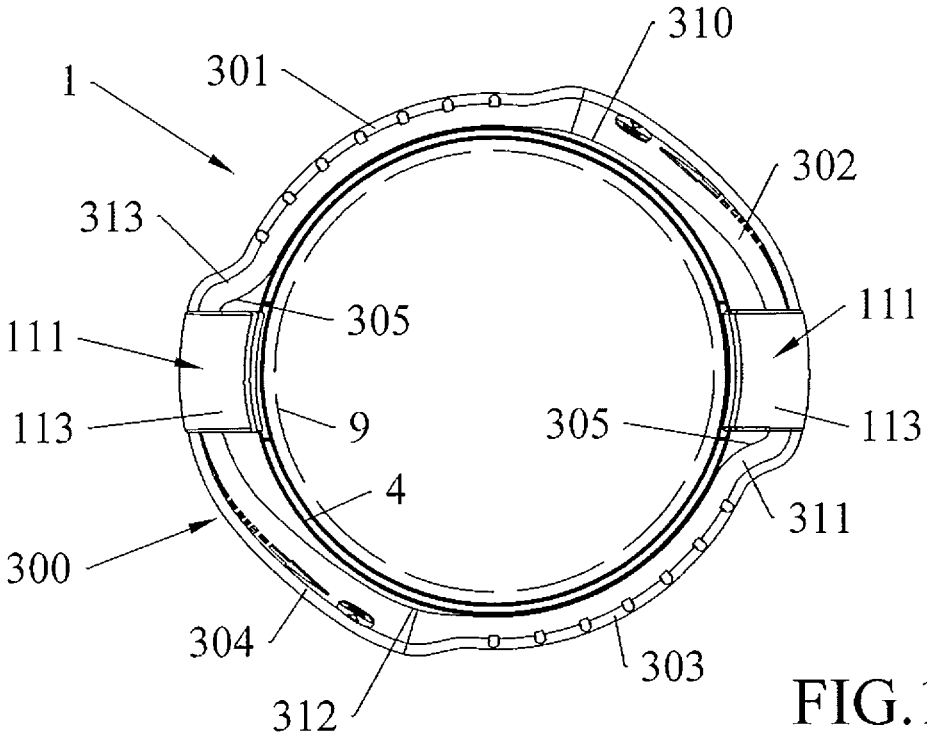
FIG. 12 shows a cross-section view of the container with clamp in release position.
Figure 13:
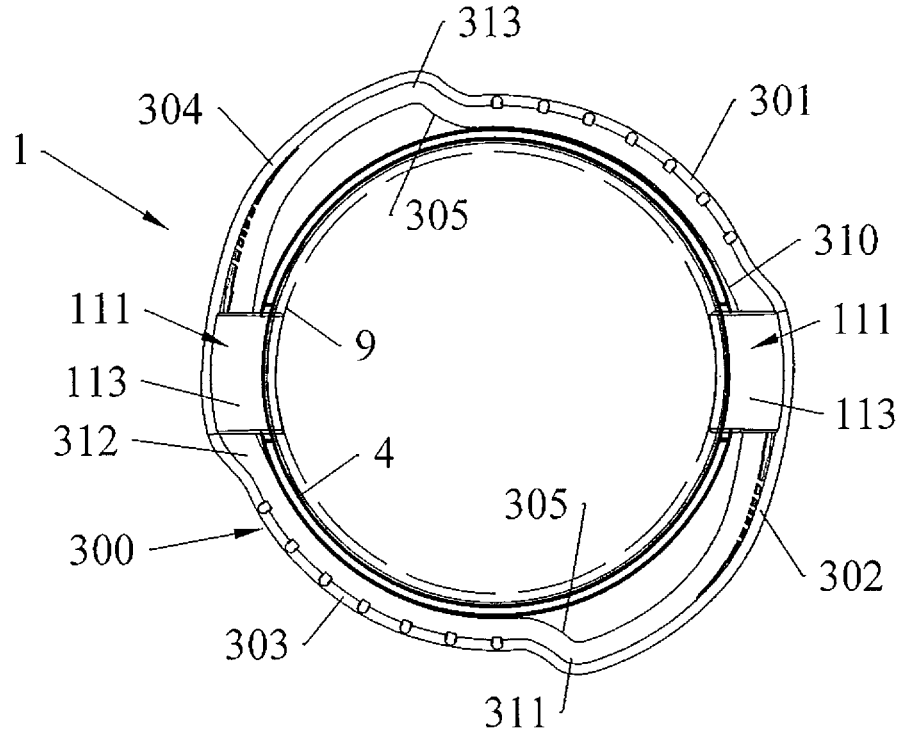
FIG. 13 shows a cross-section view of the container with clamp in sealing position.

FIGS. 5-7 show an assembly comprising an internal adaptor 100 adapted to accommodate a ring 110 with external thread 111 located as described above on the head of many of the current cylinders 200, for connecting to the guns 20.

The adaptor 100 comprises a passing hole 101, a circular internal compartment 102 for the ring 110, and an external circular compartment 103 for the external adaptor 23.

Advantageously the container 1 according to the invention is usable for any type of cylinder containing pressurized material adapted to be applied with an external means of convenient use for the operator. The means of application could therefore not be a gun 20 but rather any means adapted to channel the substance in the cylinder towards the external environment, for example a dispensing handle such as spray can or a dispenser having button such as spray can containing shaving foam.

The substance contained may not be foamy, e.g. a lubricant (oil), a food substance, any one chemical substance difficult to apply precisely by means of the sole valve 22 of the cylinder 2, 200.

FIGS. 8-13 show the container 1 with a safety clamp 300 consisting of a ring-shaped profile having variable geometry (FIGS. 12-13) consisting of a first adjacent section 301 and which essentially follows the curvature of the cylindrical profile of the head portion 4 of the container 1, a second section 302 which tends to separate from said cylindrical profile of the head portion 4, a third section 303 similar to the first section 301 and a fourth section 304 similar to said second section 302.

The first 301 and the second section 302 include a fitting 310 in which the profile of the second section 302 progressively separates from the profile of the head portion 4 of the container 1, as the tangent rotates slightly and progressively counter-clockwise.

Instead, a fitting 311 between the second 302 and the third section 303 includes a step 305 which suddenly nears the profile of the clamp 300 to the profile of the head portion 4 of the container 1.

A fitting 312 between the third 303 and the fourth section 304 is similar to the fitting 310.

A fitting 313 between the fourth 304 and the first section 301 is similar to the fitting 311.

The clamp 300 is rotatably mounted about the container 1 above arms 111 at teeth 110. The arms 111 are flexible, fixed to the head portion by coupling means 112, and include a hook-shaped end 113 adapted to partially wrap the clamp 300 which tends to bend the arms 111 inwards.

The clamp 300 is adapted to rotate with respect to the container 1 between a sealing position (FIG. 13) in which the teeth 110 are pressed against the thread 9 thus therefore preventing the uncoupling between the base portion 3 and the head portion 4, and a release position (FIG. 12) in which the teeth 110 are uncoupled from the thread 9 thus therefore allowing the uncoupling between the base portion 3 and the head portion 4.

The first 301 and the third section 303 are for manoeuvring by the user, the second 302 and the fourth section 304 serve to near and separate the teeth 110 to and from thread 9 of the base portion 3. Essentially, arms 111 are therefore held by the clamp at the second 302 and the fourth section 304.

In sealing position (FIG. 13) the clamp 300 is configured with the arms 111 at the fittings 310 and 312 in which the profile 302 grips the teeth 110 to the thread 9, while in release position the clamp 300 is configured with the arms 111 at the fittings 311 and 313 in which the teeth 110 are not in contact with the thread 9.

Advantageously the user may tighten the clamp 300 by simply rotating it with respect to the arms 111, said sealing being much safer with respect to the simple elastic force induced by the arms 11 in the FIGS. 1-7.

Consequently the clamp 300 permits a safe, long-lasting and easy-to-make sealing.

The invention claimed is:

1. A cylindrical container for foam compound cylinder, comprising a base portion separately couplable with a head portion, and coupling means engageable with a thread of the base portion, said coupling means comprising at least one arm with teeth adapted to engage with a screw-female type attachment to a thread obtained on the external surface of the base portion adapted to be inserted in the head portion, wherein the attachment between the teeth of the arm and the thread of the base portion occurs through windows on the head portion.

2. The container according to claim 1, characterized in that said teeth are arranged at vertically various distances with respect to an attachment flange of the head of the container, so as to adapt to a pitch of the thread.

3. The container according to claim 1, characterized in that said container provides a safety clamp rotatably mounted around the container above the at least one arm at the teeth.

4. The container according to claim 3, characterized in that said clamp includes a profile having variable geometry consisting of a first adjacent section and a third section which essentially follow a curvature of the cylindrical profile of the head portion of the container, a second section and a fourth section which tend to separate from said cylindrical profile of the head portion.

5. The container according to claim 4, characterized in that the first and the second section include a fitting wherein a profile of the second section progressively separates from a profile of the head portion of the container, the second and the third section include a fitting with a step which nears a profile of the clamp to a profile of the head portion of the container, said container further comprising a fitting between the third section and the fourth section, and a fitting between the fourth section and the first section.

6. An apparatus for applying a foaming substance contained in a cylinder, characterized in that said apparatus comprises a container according to claim 1, with standard attachment flange for said cylinder, and a means of application with standard attachment flange.

7. The apparatus according to claim 6, characterized in that said apparatus includes an adaptor mounted between said two flanges for opening non-standard cylinders.

8. The apparatus according to claim 6, characterized in that said apparatus includes an internal adaptor mounted between the valved head of the cylinder and the flange of the container.

* * * * *